United States Patent [19]

LaPointe

[11] Patent Number: 5,011,220

[45] Date of Patent: Apr. 30, 1991

[54] CHAIR MECHANISM

[75] Inventor: Larry P. LaPointe, Temperance, Mich.

[73] Assignee: La-Z-Boy Chair Company, Monroe, Mich.

[21] Appl. No.: 568,631

[22] Filed: Aug. 16, 1990

Related U.S. Application Data

[63] Continuation of Ser. No. 220,558, Jul. 18, 1988.

[51] Int. Cl.[5] ..... A47C 1/02

[52] U.S. Cl. ..... 297/89; 297/84; 297/318

[58] Field of Search ..... 297/84, 85, 68, 83, 297/317, 318

[56] References Cited

U.S. PATENT DOCUMENTS

| | | | |
|---|---|---|---|
| 3,856,346 | 12/1974 | Herman | 297/318 |
| 3,913,152 | 10/1975 | Quackenbush | 297/318 X |
| 4,072,342 | 2/1978 | Johnson et al. | 297/84 |
| 4,332,417 | 6/1982 | Mizelle | 297/329 |
| 4,364,603 | 12/1982 | Johnson | 297/84 |
| 4,740,031 | 4/1988 | Rogers, Jr. | 297/85 |

*Primary Examiner*—Peter A. Aschenbrenner
*Attorney, Agent, or Firm*—Harness, Dickey & Pierce

[57] ABSTRACT

An incliner chair has a back and seat unit mounted on a base by way of slanted tracks and wheels at the rear and swing links at the front so that the unit can move by gravity from a rear upright position to a front recline position. Positioning linkage means for holding the unit in the upright and recline positions is provided and this may be activated by a short stroke handle concealed between the side of the unit and the base. A leg rest assembly is connected to the unit to move with it and provide a means to return the unit from the recline position to the upright position.

16 Claims, 5 Drawing Sheets

CHAIR MECHANISM

This is a continuation of U.S. patent application Ser. No. 220,558, filed Jul. 18, 1988.

BACKGROUND OF THE INVENTION

This invention relates to furniture and, in particular, to chairs and similar articles of furniture such as sofas and love seats.

It is a basic purpose of this invention .to provide an improved support and operating mechanism for chairs of the type having an integral back and seat frame which is movable between a normal upright position and a tilted or recline position, such chairs being known in the furniture industry as "incliners" or "two-way recliners".

It is also a purpose of this invention to provide an incliner chair construction wherein the weight of the integral seat and back frame and the person occupying the chair are utilized as power means to operate mechanism for moving the chair from the upright position to the tilted or recline position, and, preferably, to operate mechanism at the same time for moving a leg rest assembly from a stored position to an elevated, operative position.

Another purpose of the invention is to provide a short-stroke lever concealed in the upholstery of the chair which may be operated by occupant of the chair to activate movement from the upright to the recline position.

An additional purpose of the invention is to provide a chair having recline motion which permits the use of a loose or reversible seat cushion.

BRIEF SUMMARY OF THE INVENTION

In a preferred form of the invention, the chair has an outer frame with transversely aligned tracks on opposite sides. The tracks have front ends which are lower than their back ends. An inner back and seat frame is movably supported on the outer frame by a pair of transversely aligned wheels, at the rear of the inner frame, which ride in the tracks. A pair of downwardly extending swing links at the front of the inner frame are pivoted to it and to the outer frame and swing on their pivots to elevate the front of the inner frame when the wheels move down the tracks.

The inner frame is also supported on the outer frame by left and right hand drive link assemblies. Each of these assemblies includes a long link that is pivoted at its front and lower end to the outer frame at a point adjacent the pivots of the swing links. The drive link assemblies each include a short drive lever that has a pivot connection to the rear and upper end of the long link. The drive levers are mounted on and driven by a transverse drive shaft which is rotatably supported on opposite sides of the inner frame. When the pivot connection of each drive lever and long link is below the line of centers between the drive shaft and the pivot of the long link to the outer frame, the drive link assembly acts as a toggle-type releasable locking means to hold and support the inner frame in its upright position. When the pivot connection of each drive lever and long link is over center, weight of the inner frame and chair occupant, and, preferably, force by a power assist spring, will cause the inner frame to move as a carriage down the tracks. This movement rotates each drive lever (and, therefore, the drive shaft) and continues until a stop means prevents any more relative rotation of the drive lever and long link about the pivot connection between them. In the stopped condition, wherein the inner frame is in a position of maximum tilt and forward movement, each drive link assembly can support inner frame load, as transmitted to it by the transverse drive shaft, and transfer it into the outer frame. The drive link assemblies therefore act with the rear wheels and the front swing links to solidly support the inner frame in the recline and upright positions on the outer frame.

The means for moving the pivot connections over center to release the inner frame from the upright position for movement to the recline position comprises a handle mounted on a side of the inner frame. In this location it is preferably hidden by the upholstery of the chair, though readily reached by a person seated in the chair. Suitable stops limit movement of the handle to a short stroke of 3 inches or so. This is sufficient, however, to drive a pair of interconnected links to rotate the drive shaft enough to bring the pivot connections over center and release the locking means holding the inner frame in the upright position.

Preferably, rotation of the drive shaft by weight of the inner frame and an occupant is also used to operate a leg rest assembly and a leg rest toggle mechanism. The leg rest assembly and toggle mechanism are generally similar to those shown in assignee's U.S. Pat. Nos. 3,099,487, issued Jul. 30, 1963, entitled "Leg Rest Fixture and Supplemental Holding Mechanism", and 4,367,895, issued Jan. 11, 1983, entitled "Reclinable Chair" though some differences will be apparent such as use of a mid-ottoman between the left and right hand pantograph linkages.

DETAILED DESCRIPTION OF A PREFERRED EMBODIMENT OF THE INVENTION

Figures 3, 4:
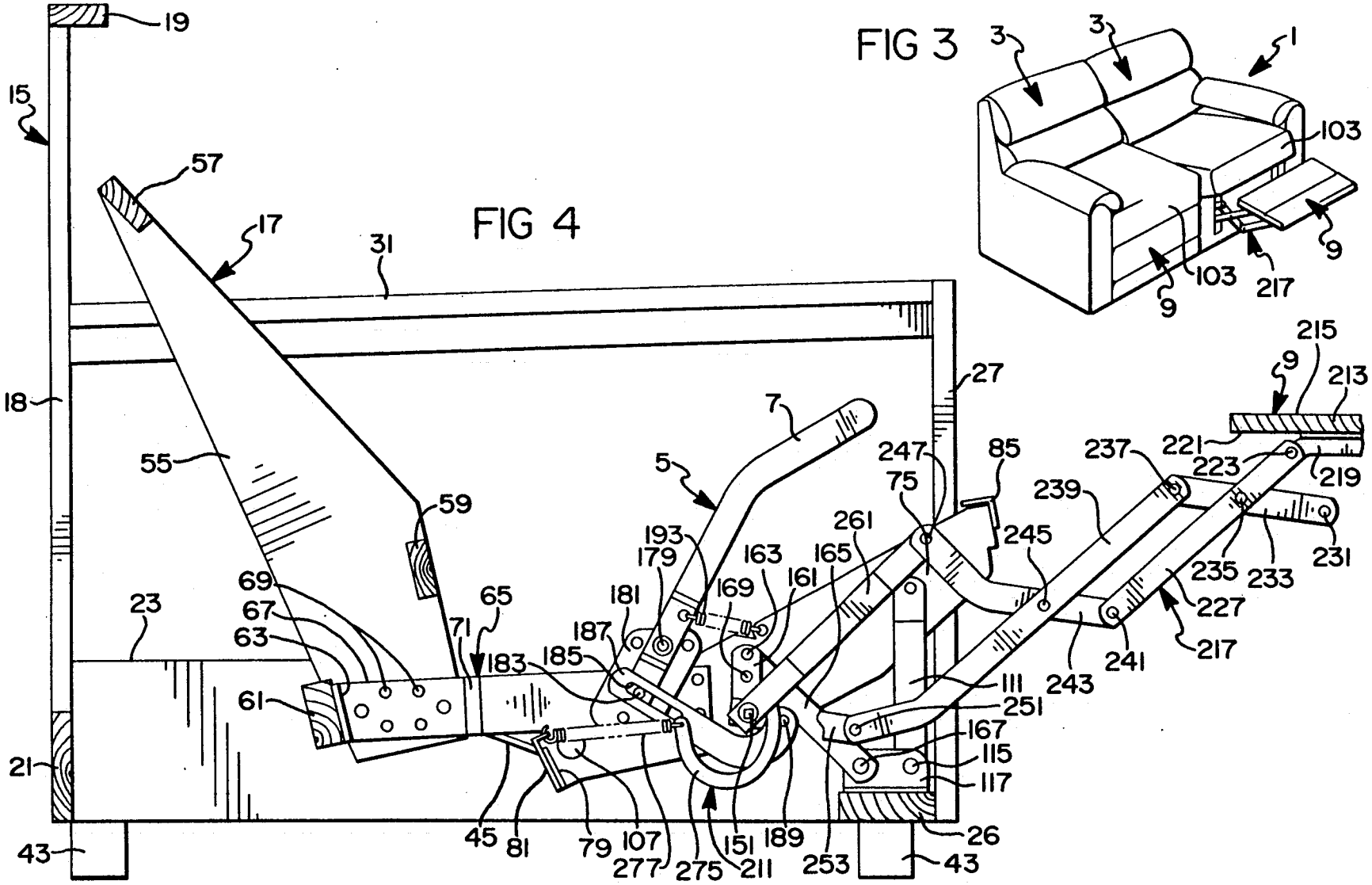
FIG. 3 is a view similar to FIG. 1 but shows the left hand seating unit and tilted seat position.
FIG. 4 is a cross section similar to FIG. 2 but taken of the left hand seat unit the position shown in FIG. 3.

The particular chair embodiment shown herein to illustrate the invention is a seating unit for a love seat 1. This is composed of left and right hand upholstered seating units 3 constructed in accordance with the invention. Each seating unit 3 has an actuating lever 5 with a top handle portion 7 that can be easily reached by a person seated in the unit. In the case of the left side unit, the handle is adjacent the left hand of a person occupying the unit; and in the case of the right side unit the handle is adjacent the right hand of the occupant. Referring to FIGS. 3 and 4, if the handle 7 is pulled two or three inches to the rear, internal mechanism is actuated that raises a leg rest assembly 9 and allows an integral back and seat assembly to move forwardly and tilt backwardly. For example, the seat may travel forwardly about 3 inches and the back drop about 4 inches.

Figure 5:
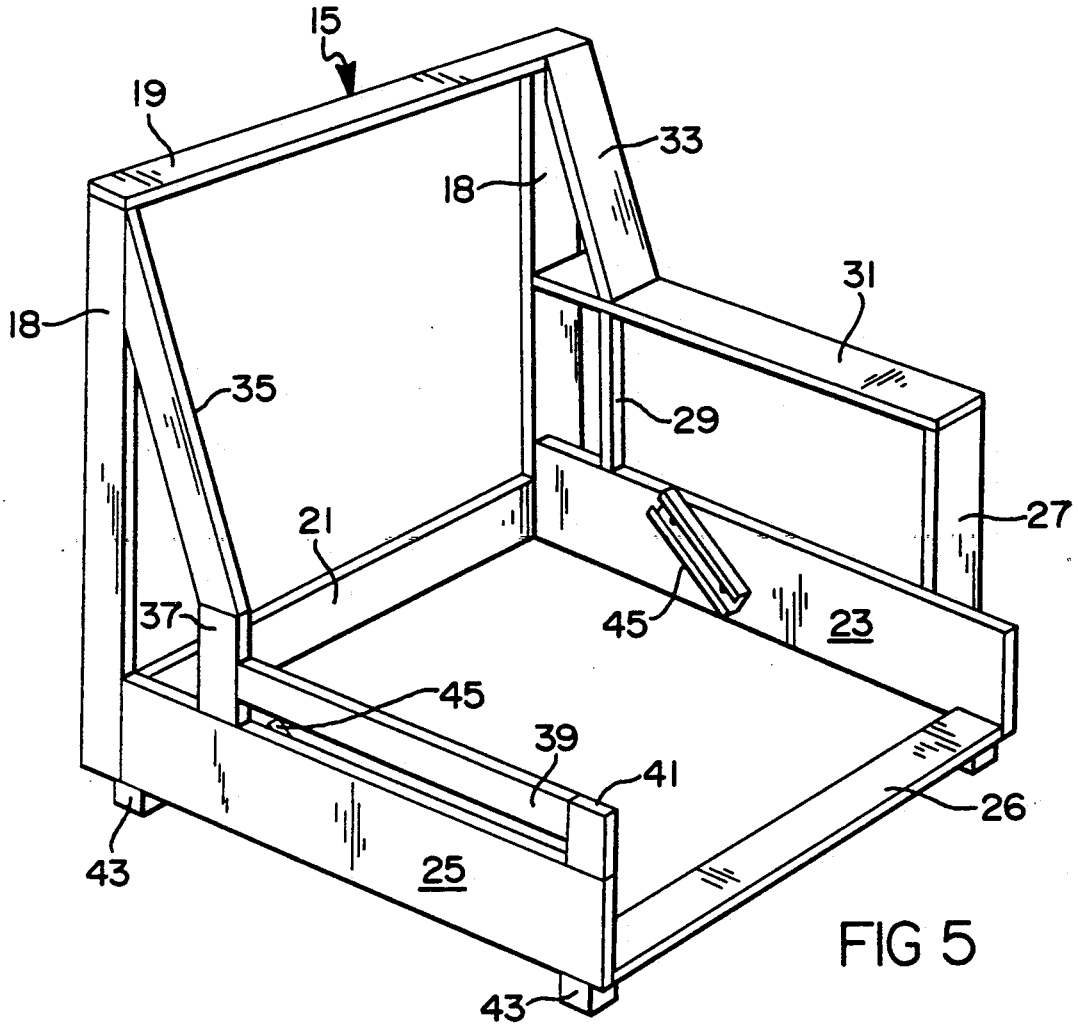
FIG. 5 is a perspective of the outer frame and base (with upholstery removed) of the left hand seating unit of FIGS. 1 and 3, it being understood that the right hand unit will be the same except on the right hand.

Each unit 3 has a stationary outer frame or base 15 and a wheeled inner frame or carriage 17 that is movably supported by the outer frame 15 and inside of it. As seen best in FIG. 5, the outer frame 15 is preferably made of several wood strips of rectangular cross section that are fixedly secured together by suitable fasteners, such as dowels, staples, nails, and screws (not shown), and which may be reinforced at critical joints by metal reinforcement plates or brackets and/or wood corner blocks (not shown). The frame 15 has a vertical back or rear section comprising vertical corner posts 18 and a horizontal top rail 19 extending between and affixed to the posts. A horizontal bottom rail 21 extends between and is affixed to the lower ends of the posts 18. The frame 15 has a bottom section that includes the rail 21 and the lower portions of posts 18 and also includes horizontal side rails 23 and 25 as well as a horizontal front rail 26 which extends between and is affixed to lower portions of the front ends of the side rails 23 and 25. Rail 23 is on the outside of the frame 15, being on the left side for a left hand unit (as in FIG. 5) and on the right side for a right hand unit. Rail 23 forms the lower portion of a side arm section for the frame 15 (and the seating unit) which is obtained by affixing vertical front and rear posts 27 and 29, respectively, to the rail and affixing a horizontal side arm rail 31 on top of the posts 27 and 29. The rail 31 is preferably extended to and affixed to rear corner post 18. A diagonal brace piece 33 may be used between the arm rail 31 and the top rail 19. Similarly, a diagonal brace 35 may be used between the other (inner) corner post 18 and a short rear vertical post 37 affixed on inner side rail 25. A horizontal top inner side rail 39 may be used between the post 37 and a short front post 41 on the inner side rail 25 to help define the inner edge of the modular unit 3 where it abuts the other unit 3, i.e., at the midplane of the love seat. Four suitable feet 43 may be affixed to the bottom of the frame 15 to support the bottom rails a desired distance above the floor. Each of the side rails 23 and 25 has a forwardly and downwardly inclined metal channel 45 affixed to its inside face. They are transversely aligned and serve as a track and support for wheels 47 on the carriage 17 as will be referred to hereinafter.

The inner frame or carriage 17 is preferably composed of both wood and metal parts. Thus, it has a vertically extending back section comprising quadrilaterally shaped, vertically extending side rail members 55 (FIGS. 6, 2, 4, and 7) and top and horizontal bottom front rails 57 and 59 extending between and affixed to the members 55. The back section also includes a horizontal bottom rear wood rail 61 (FIGS. 2, 4, 7, and 8) but this is affixed to right angle flange sections 63 at the rear ends of horizontally extending metal brace brackets 65, the brackets 65 also having rear sections 67 fitting against the bottom inside faces of rail members 55 which are affixed to the members 55 by fasteners 69. The braces are outwardly offset at 71 to connect the rear sections 67 with front sections 73. The front sections 73 fit inside and against the inside faces of metal side plates 75 to which they are rigidly secured by suitable fasteners 77. The rear ends of the side plates have transverse inwardly extending flanges 79 that are rigidly affixed to ends of the vertical leg of a metal angle bar 81 that serves as a rigid horizontal, rear cross rail between the side plates 75. The front ends of the side plates have transversely inwardly extending flanges 83 (FIG. 8) that are rigidly affixed to ends of the vertical leg of a metal angle bar 85 that serves as a rigid horizontal front cross rail between the side plates 75.

Figure 8:
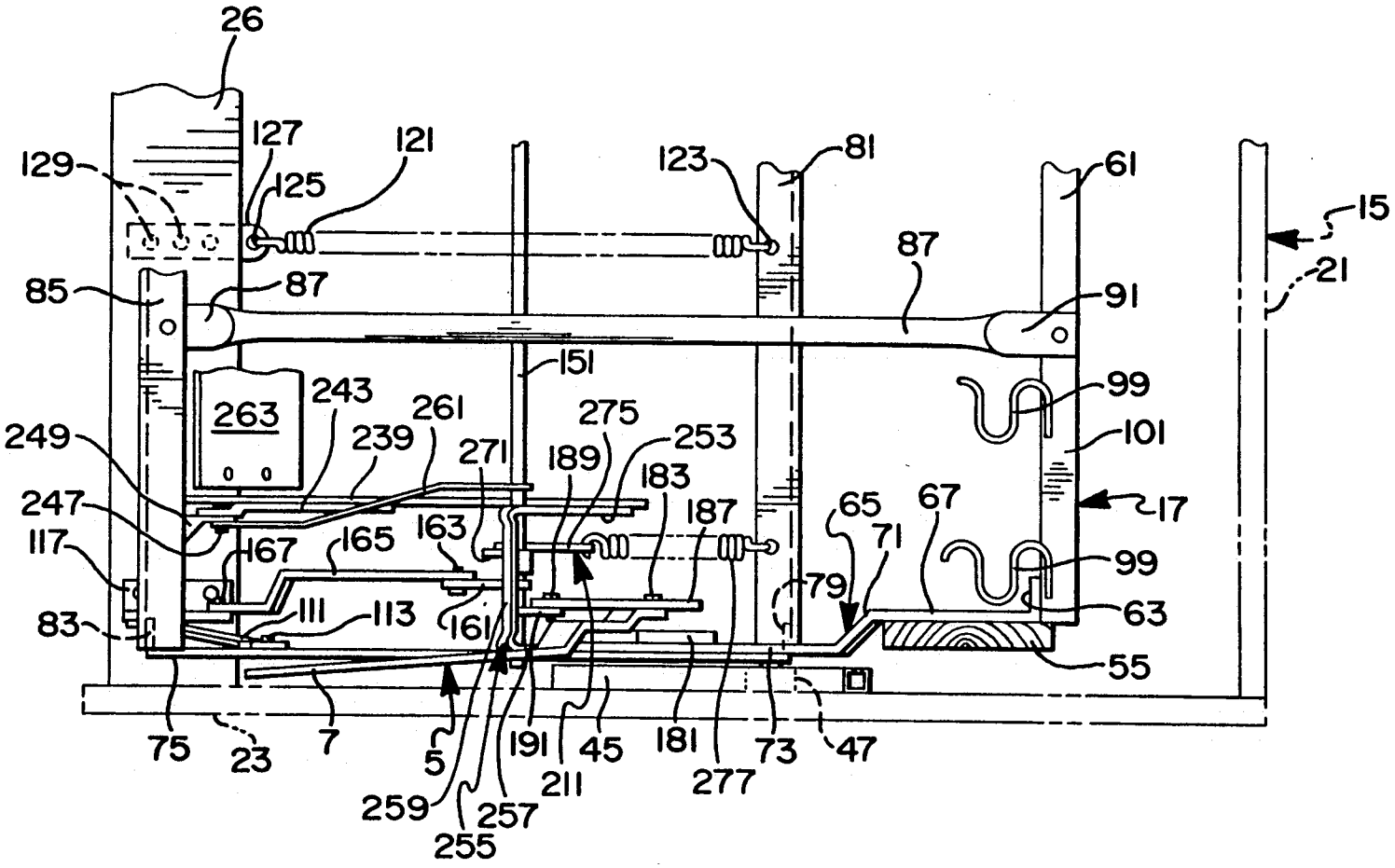
FIG. 8 is a top elevation with upholstery and parts removed and broken away of the left half of a left hand unit, it being understood that the right hand unit will be the same except on the right hand.

As seen best in FIG. 8, a centrally located curved tube 87 (concave upwardly) has a flattened front end 89 that is affixed to the front angle bar rails 85 and a flattened rear end 91 that is affixed to the top of the wooden rear rail 61 whereby the tube serves as a reinforcing brace for the seat section of carriage 17. The seat section includes transverse rails 61, 81, and 85 along with brackets 65 and side plates 75, all of which are rigidly affixed together and to the back section formed by side members 55 and cross rails 57, 59, and 61. Thus, the seat and back sections of the inner frame or carriage 17 are an integral unit which will move together.

Figure 6:
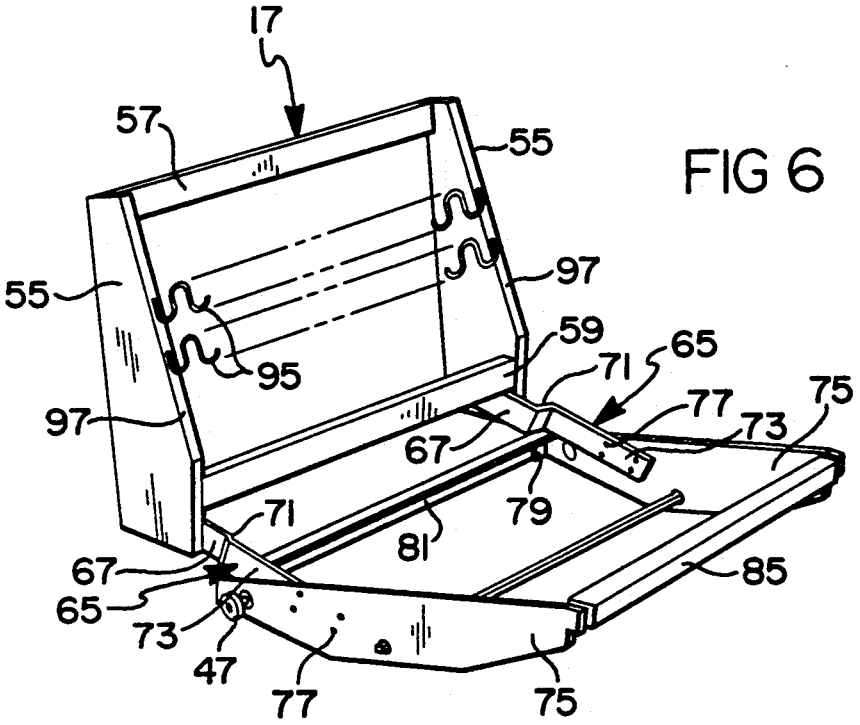
FIG. 6 is a perspective view with upholstery, springs, and other parts removed the movable seat and back carriage unit that is supported on an outer frame such as shown in FIG. 5 and other Figures.

Resiliency is provided for the back section by horizontally and transversely extending, vertically spaced, sinuous spring members 95 having opposite ends anchored on the slanted top edges 97 of the side members 55 as seen in FIG. 6. Resiliency is provided for the seat section by horizontally and longitudinally (front to rear) extending, transversely separated, sinuous spring members 99 anchored on the horizontal flange of the front angle bar rail 85 and on the top edge 101 of the rear rail 62, as seen in FIG. 8. The springs 95 and 99 are shaped to provide the desired contour for the back and for the seat, respectively. The frames and springs are padded and covered in a suitable way to provide attractive, upholstered units. In the case of the seat, it is preferred that the contour be basically flat so that removable cushions 103 of ordinary flat shapes can be supported on it.

The inner frame or carriage 17 is movably supported on the outer frame or base 15 by way of carriage side plates 75. The two rollers or wheels 47 are mounted by suitable fixtures 107 to the side plates to rotate on a common horizontal and transverse axis located just forwardly of the rear side plate flanges 79. The weight of the carriage and the chair occupant is a load on the carriage wheels 47 and will be transmitted to the tracks 45 and thus to the outer frame 15. Since the tracks 45 are downwardly and forwardly inclined, the weight of the carriage as well as the weight of a person sitting in the chair will tend to roll the wheels 47 downwardly and forwardly. The rear of the carriage is therefore translated rectilinearly in a down hill direction as the carriage moves from an upright to a recline position. The angle of the tracks may be selected to obtain the desired motion. An angle of about 20 degrees to the horizontal is illustrated and this guides the preferred motion of about four inches drop and three inches forward as the carriage goes from the upright to the recline position.

The front of the carriage 17 is connected to the outer frame by a pair of vertically extending front swing links 111 (FIGS. 2, 4, and 7) which are pivoted at their upper ends at 113 to front portions of the side plates 75 and at their lower ends at 115 to the front ends of the vertical walls of angle shaped brackets 117. Brackets 117 have their horizontal walls affixed to the top of the bottom front rail 26 of the outer frame 15.

In the leg rest retracted, upright seat position of FIGS. 1, 2, 7, and 8, the links 111 are upwardly and rearwardly inclined, i.e., the top pivots 113 to the carriage 17 are to the rear of the bottom pivots 115 to the outer frame 15. Thus, if the wheels 47 (fixtures 107 in FIGS. 2, 4, and 7) are released to roll forwardly (and downwardly) in the tracks 45, the forward motion of the side plates 75 will carry the pivots 113 forwardly. The links 111 will pivot forwardly on their bottom pivots 115 and this will raise the front ends of the side plates 75 at the same time that the back ends of the side plates are lowered by rectilinear movement of the wheels 47 down the straight inclined tracks 45. In this way the carriage pivots about the axis of wheels 47 so that the back section of the carriage 17 is tilted backwardly and the front edge of the seat section is tilted upwardly when the carriage 17 is allowed to move forwardly in the tracks 45. The limit of tilting or recline is reached when the links 111 are vertical as in FIG. 4. There is no relative movement between the back section and the seat section of carriage 17 and the removable cushions 103 are therefore not disturbed by forward motion or by tilting of the carriage.

In addition to the effect of gravity that urges the carriage 17 to move forwardly, it is preferable to have power spring assistance. For this purpose, a longitudinal coil spring 121 is shown (FIG. 8) which is anchored at its back end at 123 to the angle bar rail 81 of the carriage 17 and at its front end at 125 to a plate 127 that is secured to the bottom of front rail 26 of the outer frame 15 preferably by a screw through a selected one of a series of longitudinally spaced holes 129 in the plate (FIG. 8) whereby the stretch of the spring 121 can be adjusted. The spring 121 is under tension and therefore tends to pull the carriage 17 toward the front rail 26 of the outer frame 15.

As previously suggested, the lever 5, which is hidden in the space between the outside edge of a cushion 103 and the upholstered inside face of the high or outer side of the outer frame 15, is pulled back two or three inches by its forwardly extending handle 7 when the person occupying the seat wants it to tilt back and raise the leg rest, i.e., go to the recline position. Pulling back on the lever 5 produces angular movement (counterclockwise in the drawings) of a square cross section transverse drive shaft 151 which is rotatably supported by suitable means at opposite ends on the two side plates 75 of the inner frame 17. The axis of shaft 151 is parallel to the axis of rotation of wheels 47 and spaced forwardly of it but rearwardly of the axis of pivots 113. As will be seen hereinafter, the inner frame 17, leg rest assembly 9, and drive shaft 151 are interconnected so that when one moves, all move, i.e., turning of shaft 151 is accompanied by movement of the carriage 17 and leg rest assembly 9.

Angular movement of the cross shaft 151 about its axis rotates the rear ends of short left and right hand drive levers 161 which have square holes receiving the shaft 151. Each lever is in approximate longitudinal alignment with the vertical wall of an angle bracket 117. The front end of each drive lever 161 is pivoted at 163 to the rear and upper end of a substantially longer connecting link 165. The front and lower end of each connector link 165 is pivoted at 167 to a rear portion of the vertical wall of an angle bracket 117. A straight line between the center of cross shaft 151 and the center of each pivot 167 is a key reference feature. When the carriage is in the upright position of FIGS. 1, 2, 7, and 8, the pivot 163 is below this straight line, i.e., below center, and each connector link 165 and its drive lever 161 act, in effect, as a strut that prevents forward movement of the carriage 17. However, when the shaft 151 is turned by rearward movement of lever 5, the pivots 163 are lifted above their respective reference lines or above center. Then the links 165 no longer resist forward movement and the effect of gravity (and of the tension in spring 121 if used) forces the carriage 17 to move forwardly. As this occurs, the links 165 pivot upwardly and the pivots 163 move upwardly and forwardly, each in an arc about its front pivot 167. This lifts the front end of each drive link 161 which turns the shaft 151 which, in turn, automatically operates the leg rest mechanism 9 as will be referred to hereinafter.

Each lever 161 has a solid stop pin 169 (FIG. 4) projecting transversely from the link 165 side of lever 161 so that as the lever 161 rotates upwardly the pin 169 will eventually contact the bottom of the link 165 and prevent any further rotation in that direction about pivot 163. The lever 161 and link 165 then become, in effect, a strut acting between shaft 151 and pivot 167 to block any more forward motion of the carriage. As seen in FIG. 4, at this point each lever 161 is substantially vertical with pivot 163 just above or just to the rear (over center) of cross shaft 151. Links 111 are also substantially vertical. Engagement of stop pins 169 with the bottoms of links 165 provides stop means that determine the limits of tilt and forward movement of the carriage 17. This engagement provides solidity and stability to the tilted carriage and acts with the swing links 111 and the engagement of wheels 47 with the tracks 45 to transfer loads on the carriage in its recline position into the outer frame 15. The lever 161 and connector link 165 subassemblies serve, therefore, as positioning means for holding the inner frame 17 in the upright and recline positions.

Figures 1, 2:
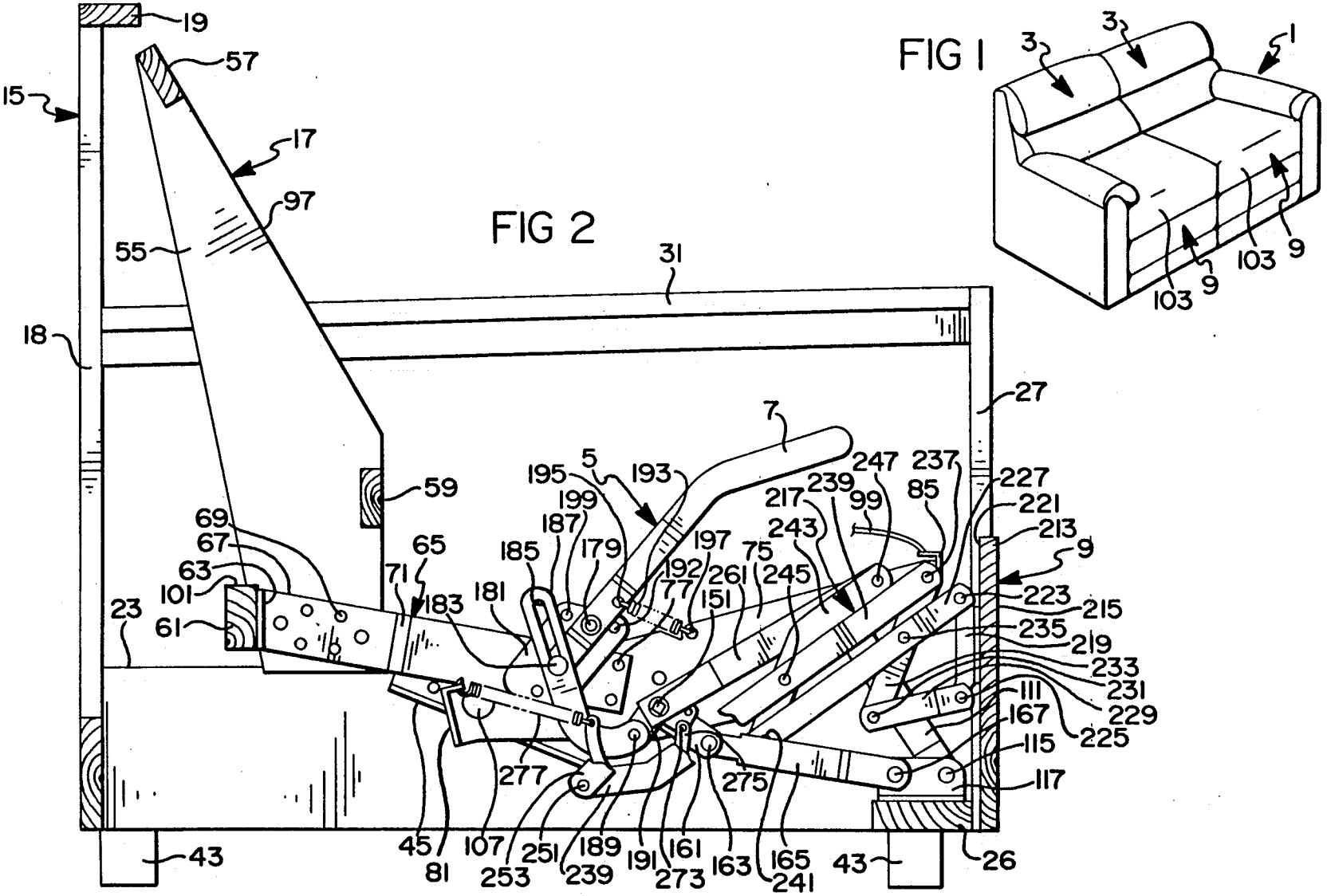
FIG. 1 is a perspective view of an upholstered modular love seat having left hand seating units embodying the invention.
FIG. 2 is an enlarged cross section through the left hand seating unit of FIG. 1 with upholstery omitted and parts broken away or omitted for clarity to show the internal operating mechanism of the chair.

The activating lever 5 is pivotally mounted at 179 on a support plate 181, adjacent the top thereof. Plate 181 has a bottom portion that is rigidly affixed to a side plate 75 and bracket 65 where they overlap. The bottom of lever 5 has a rigid transverse pin 183 that rides in a slot 185 in the stem part of a J-shaped link 187. The pin 183 is at the bottom of the slot 185 when the seat is in the upright position with the leg rest retracted (FIG. 2). The foot part of the J-shaped link is pivoted at 189 to the lower end of a rearwardly and downwardly extending drive link 191 (FIGS. 2 and 8), the upper end of the link 191 having a square hole through which the square cross shaft 151 passes whereby the link 191 and the shaft 151 rotate together.

Thus, when the lever 5 is pulled back, its pin 183 pushes down on the J-shaped link 187 causing it to rotate drive link 191 and this produces angular movement of the cross shaft 151. This rotates drive link 161 to bring pivot 163 over center. This releases the locking means provided by links 161 and 165 which has held the inner frame or carriage 17 in the upright position whereupon gravity and spring forces on the carriage 17 move it forwardly in tracks 45 and tilt it backwardly on the axis of wheels 47 to the recline position of FIGS. 3 and 4. These also rotate drive link 191 which in turn rotates J-shaped link 187 bringing pivot 189 forwardly and moving the link 187 relative to lever 5 and its pin 183. This is accommodated by the lost motion slot 185 which moves so that its other end is adjacent the pin (FIG. 4). The lever 5 is resiliently held in a forward position against rigid stop pin 192 on plate 181 by a coil spring 193 which is anchored at one end 195 on the lever above pivot 179 and at its other end 197 to the side plate 75 ahead of the pivot 179. A rigid stop pin 199 on plate 181 is spaced behind the lever 5 to limit its rearward travel and therefore the amount of manually activated movement of drive link 191 and drive shaft 151. The stop pins 192 and 199 are preferably spaced close to each other to limit motion of lever 5 to a short stroke of only two or three inches.

The leg rest assembly 9 and a toggle mechanism 211 associated with it are seen best in FIGS. 2, 4, and 8. These are similar to, but not identical with, corresponding mechanisms shown and described in the present assignee's U.S. Pat. No. 4,367,895, issued Jan. 11, 1983, entitled "Reclinable Chair" as well as its U.S. Pat. No. 3,099,487, issued Jul. 30, 1963, entitled "Leg Rest Fixture and Supplemental Holding Mechanism".

The leg rest assembly 9 comprises a frame board 213 having an upper surface 215 that is padded and upholstered so that in the finished chair it will be as shown in FIGS. 1 and 3. The board 213 is supported on and moved by left and right hand pantograph linkages 217. These are the same and only one will be described. The board 213 has an angle shaped bracket 219 secured to its bottom face 221 for each pantograph whereby it is pivotally connected at a rear pivot 223 and a front pivot 225 to board links 227 and 229, respectively, of the pantograph. The other end of front board link 229 is pivoted at 231 to an end of connector link 233 and link 233 is centrally pivoted at 235 to an upper part of connector link 227. The other end of link 233 is pivoted at 237 to the top of long support link 239.

The other end of link 227 is pivoted at 241 to one end of a curved link 243, link 243 being pivoted at a central pivot 245 to a central part of long support link 239. The other end of curved link 243 is pivoted at 247 to the rear end of a rearwardly extending bracket 249 (FIG. 8) that is affixed to the bottom of carriage front cross rail 85, extending rearwardly from it. Pivot 247 is a point of support on carriage 17 for the pantograph.

Another point of support is pivot 251 at the curved bottom end of long support link 239 which connects link 239 to the end of the long leg 253 of a partially U-shaped drive and spacer bracket 255. The bracket 255 has a short leg 257, at its transversely outer end, parallel to leg 253, which is joined to leg 253 by a base 259 of the U. Both legs 253 and 257 have square aligned holes in them through which the square drive shaft 151 extends so that base 259 is parallel to the shaft. Thus, turning of the square shaft 151 turns the crank arm provided by long leg 253 of drive bracket and this acts through pivot 251 to move the long support link 239. This causes link 243 to swing about fixed pivot 247 by virtue of the pivot connection 245 that it has with long link 239. That moves rear board link 227 while the pivot 237 at the top end of long link 239 will move link 233 and thus front board link 229. This action takes place with both the left hand and right hand pantographic linkage mechanisms when there is angular movement of the cross shaft 151. The effect is to move the board 213 between its stowed vertical position (FIG. 2) and its elevated, operative, horizontal position (FIG. 4).

Part 261 in FIGS. 2, 4, and 8 is a spacer link (which may be ribbed as shown in U.S. Pat. No. 4,367,895) that is pivotally supported at its bottom end on shaft 151 and at its top end on pivot 247 to bracket 249. It serves to stabilize and locate the shaft 151 and the linkage mechanism. Part 263 in FIG. 8 is a mid-ottoman board which can be secured at opposite ends to the straight portions of long support links 239 for the left and right hand pantographs between pivots 237 and 245.

There are left and right hand toggle link mechanisms 211 which, as pointed out in U.S. Pat. Nos. 3,099,487 and 4,367,895, work with the leg rest assembly. Each is mounted on shaft 151 between opposite legs 253 and 257 of bracket 255. The toggles provide a means to hold the leg rest 9 tightly in fully retracted position against the front of the chair and also a means to supply a spring assist as the the leg rest is being extended. The mechanism 211 includes a lever 271 with a square hole and mounted by means of that hole on the square shaft 151 so that it turns with the shaft. The lever 271 is pivoted at 273 to the front end of a C-shaped toggle link 275 that curves around below and to the rear of shaft 151 where it has an opening in which is hooked the front end of a helical coil tension spring 277 that has its back end hooked to the rail 81. The location of pivot 273 below shaft 151 and the line of action of spring 277 are such in the retract position of leg rest 9 that the spring force, which is maximum at that position, tends to turn the shaft 151 in the direction of holding the leg rest retracted. As the leg rest is elevated, the pivot 273 will move up and over center and tension in the spring 277 will assist in elevation of the leg rest as the end of the link 275 moves closer to the rail 81.

Downward pressure applied manually to the frame board 213 serves as means to move the inner frame 17 back to the upright position. Such pressure has the benefit of a long moment arm and produces a downward movement of long support links 239 which act through their pivots 251 to move legs 253 of driver brackets 255 in a rearward direction. This rotates the drive shaft 151 and the drive levers 161 (clockwise in the drawings) and applies forward forces to pivots 163. These are resisted by the connector links 165 thereby forcing the shaft 151 and the inner frame 17 to move backwardly to the upright position. When the pivots 163 are rotated over center, the drive levers 161 and their connector links 165 again act as toggle-type locking means to solidly hold the inner frame 17 in the upright position until released by operation of handle 5.

Thus, the invention provides a chair construction that has a seat and back frame 17 that moves between an upright position (FIG. 2) and a recline position (FIG. 4) located ahead of the upright position. Gravity, and, preferably, a simple spring 121 (FIG. 8), are used to drive the frame from the upright to the recline position. Manual force, leveraged through the leg rest linkages 217, is used to overcome gravity and the spring and return the frame 17 from the recline to the upright position.

The rear and bottom of the frame 17 are supported by track means, comprising tracks 45 and wheels 47, so that the frame can roll back and forth on the base frame 15. The tracks 45 slant down to enable weight of the frame and occupant to drive the frame 17. As the frame 17 moves forward, its front edge is lifted by the swing links 111 which are pivoted to it and to the base frame 15.

The frame 17 is releasably held in the upright position, so that it cannot move forwardly, by toggle lock action of the drive link assemblies comprising drive levers 161 and connector links 165. The levers 161 are mounted on and rotate with the drive shaft 151 which is rotatably supported on frame 17 and moves back and forth with it. The shaft 151 can h=manually turned by a person sitting in the chair who pulls back on a concealed handle 5. This acts through lost motion links 187 and 191 to move the shaft 151 (counterclockwise in FIG. 7 and the other drawings) just enough to break the toggle and allow gravity and spring 121 to move the inner frame in a forward direction. This also brings the leg rest toggle mechanism 211 over center to release the leg rest assembly 9.

Figure 7:
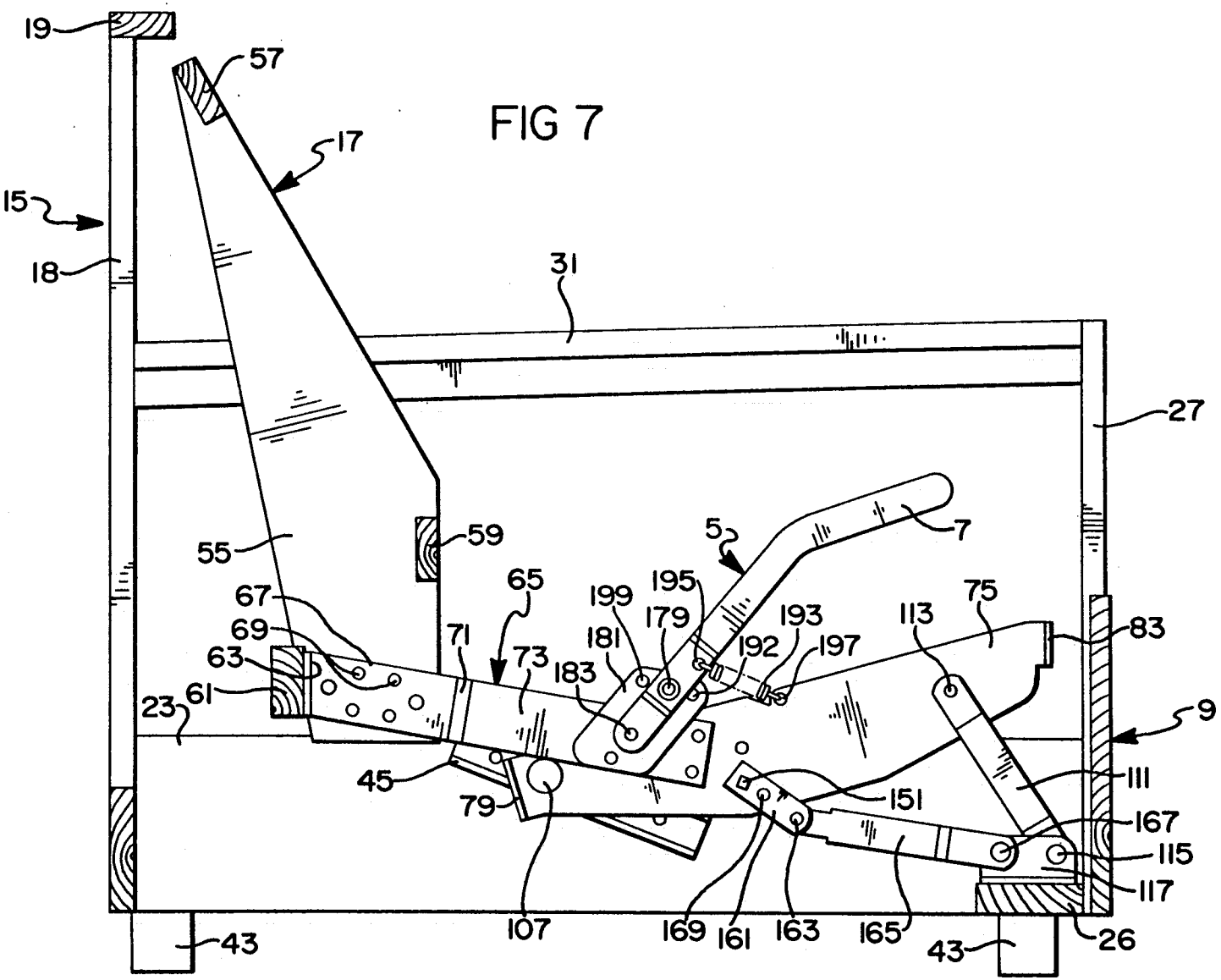
FIG. 7 is a cross section similar to that of FIG. 2 but with parts omitted.

Forward movement of the frame 17 requires the links 165 to pivot upwardly and this drives levers 161 so that they rotate the drive shaft 151 (counterclockwise in FIG. 7 and the other drawings). Turning of shaft 151 in this direction rotates the long legs 253 of drive brackets 255 in a forward direction. They act through the pivots 251 at the bottoms of long links 239 of pantographs 217 to elevate the leg rest to the horizontal, operative position of FIG. 4. This position and the final recline position of frame 17 are determined by the stop means provided by transverse pins 169. When these engage the bottom edges of connector links 165, forward motion stops and the frame 17 is supported in a stable, recline position. To return the frame 17 to the upright position, the leg rest frame 213 is pushed until it reaches the stored position of FIG. 2. This rotates the drive shaft 151 and moves the linkages back to the places shown in FIG. 2.

The drawings show the chair of this invention embodied in a love seat 1. It could also be used in ordinary, single person chairs as well as in sofas, modular sections, or other articles of furniture. Modifications in the specific structure shown may made without departing from the spirit and scope of the invention.

What is claimed is:

1. A chair comprising a base, a seat and back frame, support means movably mounting the frame on the base for translatory movement between an upright first position and a recline second position, a transverse shaft mounted at opposite ends on opposite sides of the frame for angular movement in a first direction and for angular movement in a second direction opposite to the first direction and for translatory movement with the frame, connection means connecting the shaft to the base so that said shaft moves in the first direction when said frame moves from the upright first position to the recline second position and said shaft moves in its second direction when said frame moves from the recline second position to the upright first position, said connection means including frame positioning means for holding the frame in the upright first and recline second positions, a leg rest assembly mounted on the frame for movement between a retracted first position and an extended second position, said leg rest assembly being supported on said frame and connected to said shaft so that movement of the shaft in its first direction moves the leg rest assembly from its retracted first to its extended second position, said leg rest assembly being connected to said shaft so that movement of the leg rest assembly from its extended second position to its retracted first position moves said shaft in its second direction and in a translatory direction and thereby moves the frame from its recline second position to its upright first position.

2. A chair as set forth in claim 1 including a leg rest spring-urged toggle mechanism connected to said shaft and operative to yieldably hold the leg rest assembly in its first position.

3. A chair as set forth in claim 1 wherein said support means includes track and wheel means constructed and arranged whereby the weight of the frame and a person in the frame urges the frame to move from the first to the second position and the shaft to move in its first direction.

4. A chair as set forth in claim 1 including spring means acting between the frame and the base and urging the frame to move from the first to the second position and the shaft to move in its first direction.

5. A chair as set forth in claim 1 wherein said support means includes track and wheel means constructed and arranged whereby the weight of the frame and a person in the frame urges the frame to move from the first to the second position and the shaft to move in its first direction and the leg rest assembly to move from its first to its second position.

6. A chair as set forth in claim 3 wherein said frame positioning means includes a toggle arrangement for holding the frame in the first positioning and a stop element arrangement for holding the frame in the second position.

7. A chair as set forth in claim 6 including chair occupant operated means connected to said shaft for moving said shaft in its first direction a sufficient amount to overcome said toggle arrangement.

8. A chair as set forth in claim 7 wherein said chair occupant operated means comprises a short stroke handle mounted on said frame and having a lost motion connection with said shaft.

9. A chair comprising an outer frame and base, an inner frame having a unitary seat and back, and support means mounting the inner frame on the outer frame for support of the inner frame and for translatory movement of the inner frame between an upright position and a recline position located ahead of the upright position, said support means including substantially straight tracks and a pair of wheels in the tracks and having a transverse axis of rotation located adjacent the rear and bottom of the inner frame, said support means including link means acting between the frames to tilt the inner frame about said axis of rotation during movement of the inner frame between said positions with the front of the inner frame being elevated as the inner frame moves toward the recline position, said tracks being located at an angle to the horizontal with the backs higher than the fronts whereby the weight of the inner frame and of a person seated in the inner frame provides a force acting to move the inner frame toward said recline position, toggle link means connected to the frame supporting said inner frame on the outer frame and for releasably holding the inner frame in the upright position, chair occupant operated means connected to the toggle link means for moving the toggle link means to release the inner frame, a transverse drive shaft rotatably mounted on the inner frame for translatory movement with frame, said toggle link means being operatively connected to said drive shaft so that rotation of the drive shaft moves the toggle link means and movement of the toggle link means rotates the drive shaft, said chair occupant operated means being operatively connected to said drive shaft to rotate the drive shaft through a predetermined and limited angle in order to move the toggle means to release the inner frame, means associated with said toggle means and operative to limit forward movement of the inner frame and hold it in the recline position, a leg rest assembly having linkage means operatively connected to said drive shaft so that rotation of the drive shaft moves the leg rest assembly from stored position to extended position and movement of the leg rest assembly from elevated to stored position rotates the drive shaft and translates the drive shaft to move the inner frame from the recline position to the upright position, said leg rest assembly automatically being in stored condition when the inner frame is in the upright position and automatically in extended and operative condition when the inner frame is in the recline position, and leg rest toggle mechanism operatively connected to said drive shaft so that rotation of the drive shaft moves the toggle mechanism, said leg rest toggle mechanism releasably holding the leg rest assembly in the stored condition.

10. A chair as set forth in claim 9 wherein the outer frame has opposite side portions and the inner frame has opposite side portions spaced inwardly from the adjacent side portions of the outer frame, said tracks being mounted on the side portions of said outer frame and said wheels being rotatably mounted on the side portions of the inner frame.

11. A chair as set forth in claim 10 wherein said chair occupant operated means comprises a handle pivoted on a side portion of said inner frame and lost motion linkage connecting the handle to the drive shaft and stop means on said side portion to limit pivoting of the handle.

12. A chair as set forth in claim 11 wherein said drive shaft is mounted on said side portions of the inner frame on an axis located parallel to but forwardly of the axis of rotation of the wheels.

13. A chair as set forth in claim 12 wherein said toggle link means includes a drive lever mounted on the drive shaft for rotation with it and a connector link having a pivot connection with said drive lever and being secured by a pivot means to said outer frame, said toggle link means being operative to hold said inner frame in upright position when said pivot connection is below the line of centers defined by said drive shaft and said pivot means.

14. A chair as set forth in claim 13 wherein said stop means comprises a transverse stop pin on said drive lever engageable with the connector link when the inner frame reaches the recline position to thereby prevent pivoting of the drive lever and connector link about said pivot connection in a direction energized by the weight of the inner frame and occupant, whereby said toggle link means acts as a strut between said pivot means and said drive shaft to block forward movement of the inner frame.

15. A chair as set forth in claim 14 including a power assist spring means acting between the inner and outer frames to resiliently urge the inner frame toward the recline position.

16. A chair comprising an outer frame and base, an inner frame having a unitary seat and back, and support means mounting the inner frame on the outer frame for support of the inner frame and for translatory movement of the inner frame between an upright position and a recline position located ahead of the upright position, said support means including substantially straight tracks and a pair of wheels in the tracks and having a transverse axis of rotation located adjacent the rear and bottom of the inner frame, said support means including link means acting between the frame to tilt the inner frame about said axis of rotation during movement of the inner frame between said positions with the front of the inner frame being elevated as the inner frame moves toward the recline position, said tracks being located at an angle to the horizontal with the backs higher than the fronts whereby the weight of the inner frame and of a person seated in the inner frame provides a force acting to move the inner frame toward said recline position, a drive shaft rotatably mounted on said inner frame and for translatory movement with the inner frame, drive means operatively connecting the drive shaft to the outer frame whereby movement of the inner frame relative to the outer frame rotates the drive shaft, and a leg rest mechanism supported on the inner frame for translatory movement with it and operatively connected to said drive shaft so that rotation of the drive shaft elevates the leg mechanism and force applied to the leg rest mechanism in a direction to move it to stored position rotates the drive shaft to lower the leg rest mechanism to stored position and moves the inner frame to upright position.

* * * * *

UNITED STATES PATENT AND TRADEMARK OFFICE

CERTIFICATE OF CORRECTION

PATENT NO. : 5,011,220

DATED : April 30, 1991

INVENTOR(S) : Larry P. LaPointe

It is certified that error appears in the above-identified patent and that said Letters Patent is hereby corrected as shown below:

| | |
|---|---|
| Column 1, Line 40 | after "inner" insert --integral-- |
| Column 2, Line 37 | after "left" insert --and right-- |
| Column 2, Line 44 | after "unit" insert --in the leg rest extended-- |
| Column 2, Line 46 | after "unit" insert --in-- |
| Column 2, Line 52 | after "removed" insert --, of-- |
| Column 9, Line 2 | "h=" should be --be-- |
| Column 9, Line 45 | "the" should be --its-- |
| Column 10, Line 20 | "positioning" should be --position-- |

Signed and Sealed this

Twenty-fourth Day of November, 1992

*Attest:*

DOUGLAS B. COMER

*Attesting Officer* *Acting Commissioner of Patents and Trademarks*

UNITED STATES PATENT AND TRADEMARK OFFICE

CERTIFICATE OF CORRECTION

PATENT NO. : 5,011,220

DATED : April 30, 1991

INVENTOR(S) : Larry P. LaPointe

It is certified that error appears in the above-indentified patent and that said Letters Patent is hereby corrected as shown below:

Column 12, line 21, "frame" should be --frames--.

Signed and Sealed this

Twenty-sixth Day of July, 1994

*Attest:*

BRUCE LEHMAN

*Attesting Officer*

*Commissioner of Patents and Trademarks*